United States Patent [19]

Reed

[11] 4,243,375

[45] Jan. 6, 1981

[54] GAS OR LIQUID FUEL BURNER WITH AIR REGISTER CONTROL OF TANGENTIAL/AXIAL COMBUSTION AIR MOVEMENT

[75] Inventor: Robert D. Reed, Tulsa, Okla.

[73] Assignee: John Zink Company, Tulsa, Okla.

[21] Appl. No.: 913,606

[22] Filed: Jun. 8, 1978

[51] Int. Cl.[3] ..... F23C 5/00

[52] U.S. Cl. ..... 431/174; 431/183; 431/284; 239/406

[58] Field of Search ..... 431/174, 183, 184, 284, 431/285; 239/402.5, 405, 406

[56] References Cited

U.S. PATENT DOCUMENTS

| | | | |
|---|---|---|---|
| 2,204,719 | 6/1940 | Zink | 431/174 |
| 2,325,443 | 7/1943 | Vroom | 431/184 |
| 3,367,385 | 2/1968 | Dunn | 239/406 |
| 3,529,915 | 9/1970 | Shoichi Tsuji et al. | 431/284 |

*Primary Examiner*—Carroll B. Dority, Jr.
*Attorney, Agent, or Firm*—Head & Johnson

[57] ABSTRACT

A burner system for gaseous or liquid fuels adapted for insertion through a circular tile opening in a furnace wall, comprising a burner tube for alternate supply of gaseous or liquid fuel. The burner tube is coaxial with, and inserted into said circular opening. A first stationary annular vane assembly comprises a plurality of symmetrically-placed tangentially-directed vanes enclosing a cylindrical open chamber coaxial with and upstream of said burner means. A second movable assembly of radial vanes is adapted to slide axially about the burner tube and to be moved from a first position where it is entirely outside of the chamber space, inwardly to a second position, where it is entirely inserted into the chamber space, and inside of the first annular vane assembly. Means are provided for flowing combustion air at selected pressure through the tangential vanes and into the chamber space. When the second vane assembly is moved to its first position, the tangential vanes provide a swirling helical flow of air into and axially along the chamber space, and into the downstream of the burners, providing a swirling flame. When the movable vane assembly is in its second position, inside of the chamber volume, then the tangentially-directed air flowing through the first vane assembly flows into the second vane assembly with its radial vanes. This completely cuts off the helical flow, and causes only axial flow of air past the burners and into the flame zone.

5 Claims, 4 Drawing Figures

GAS OR LIQUID FUEL BURNER WITH AIR REGISTER CONTROL OF TANGENTIAL/AXIAL COMBUSTION AIR MOVEMENT

BACKGROUND OF THE INVENTION

1. Field of the Invention

This invention lies in the field of burner systems for the combustion of gaseous or liquid fuel. More particularly, it concerns a type of burner system in which the combustion air can be directed past the burners into the combustion zone in either a completely axial direction of flow, or a completely helical direction of flow, or in some combination of axial and helical flow.

2. Description of the Prior Art

In the practice of fuel burning for a required heat release, as in now common to the fuel burning arts, it is necessary, at times and for well-known reasons to cause the air flow through the burner, for supply of oxygen to permit combustion, to be tangential in relation to the circular opening (spinning air) up to the area in which combustion is to occur. The circular opening discharges air and fuel forwardly into the furnace which is being fired.

The required amount of tangential (spinning) air movement is imparted to the air as it enters the burner structure, due to lower pressure within the burner than the pressure at which air is supplied up to the burner, or, because of air pressure drop from supply pressure to the pressure within the burner, and the furnace, which is downstream from the burner. The amount of spin is controlled by the angle of tangential vanes.

The cross-sectional area air flow entry is dependent on the chosen orientation of the tangential vanes. As the tangential positions of the vanes are altered, for "spin" control on air flow, the air entry area is correspondingly altered. Increased tangential moment (spin) reduces the air flow cross-sectional area, and decreased tangential moment has an opposite effect. Thus, the air flow pressure drop for air supply will vary greatly, according to the degree of tangential movement which is required to obtain a preferred burning condition.

As an example, and if the air flow area should be reduced to ½, for the same air requirement, four-times the air pressure drop would be required from air supply via the air register to the furnace, since air flow quantity will vary as the square root of the pressure drop. This variation in air pressure drop makes automatic control of fuel firing very difficult, but is typical of today's art of fuel burning where a selectively controlled degree of tangential air movement is required.

SUMMARY OF THE INVENTION

It is a primary object of this invention to provide a burner system for gaseous or liquid fuels, in which the combustion air can be provided to the burners and the combustion zone in the form of axial flow of air, or a spinning helical flow of air, or as a combination of axial and helical flow.

It is a further object of this invention to provide a burner system in which the flow of combustion air can be changed from an axial flow to a helical flow and vice versa without material change in the flow rate of combustion air, under constant input pressure.

These and other objects are realized, and the limitations of the prior art are overcome in this invention, by providing a burner system in which the gaseous and liquid burners are supplied with fuels through an axial pipe, which includes an inner tube for the flow of liquid fuel and an annular space for the flow of gaseous fuel. Each of these fuel-carrying spaces conduct the fuel to selected burners, which are centered within a central opening in a tile, within one wall of a furnace.

Immediately behind and upstream of the burners is a cylindrical space or open chamber, which surrounds the burner tube. This open chamber space is surrounded by a first vane assembly, which is in the form of an annular vane assembly, having a plurality of symmetrically-placed tangentially-inclined vanes. This annular vane assembly is stationary and the directions of the vanes are fixed. It is supported by the wall of the furnace by conventional means.

Outside of and coaxial with the first vane assembly is a closed cylindrical volume which houses a second annular vane assembly, which is axially movable. The second vane assembly is of smaller outer diameter than the inner diameter of the first vane assembly. Thus, by sliding on the outside of the burner tube, this second vane assembly can be withdrawn completely from the chamber volume, or it can be moved completely into the chamber volume. The second vane assembly has a plurality of equally-spaced radial vanes.

The first vane assembly is within a wind box, to which combustion air is supplied either under blower pressure, or as the result of furnace draft. The wind box guides the combustion air into the spaces between the tangential vanes, causing a flow of air into the open chamber volume in the form of a swirl, or helical motion of the combustion air. This combustion air moves downstream helically to, and past the burners, and into the combustion zone, providing a swirling flame action, as desired.

Whenever the tangential flow of air is not desired, the second movable radial vane assembly is moved axially forward into the chamber space, where the incoming air from the first vane assembly flows into the spaces between the radial vanes. Thus, the circular helical flow of air is completely stopped by the radial vanes, and the air is redirected axially within the spaces between the vanes and along the axis of the burner, past the burner nozzles, and into the flame zone. Thus, by moving the movable vane assembly from a first position where it is completely outside of the chamber volume, into a second position where it is completely inside of the chamber volume, the flow of combustion air can be changed from a circular swirling helical flow of air to the burners, and into the flame zone, to an axial flow of air past the burners and into the flame zone.

By positioning the second movable vane assembly at an intermediate point, axially between the first and second positions, a combination of axial and circumferential flow will be obtained, as desired, and as a function of the axial position of the second vane assembly.

BRIEF DESCRIPTION OF THE DRAWINGS

These and other objects and advantages of the invention and a better understanding of the principles and details of the invention will be evident from the following description taken in conjunction with the appended drawings, in which:

FIG. 1-A illustrates a detail of FIG. 1.

DESCRIPTION OF THE PREFERRED EMBODIMENT

Figure 1:
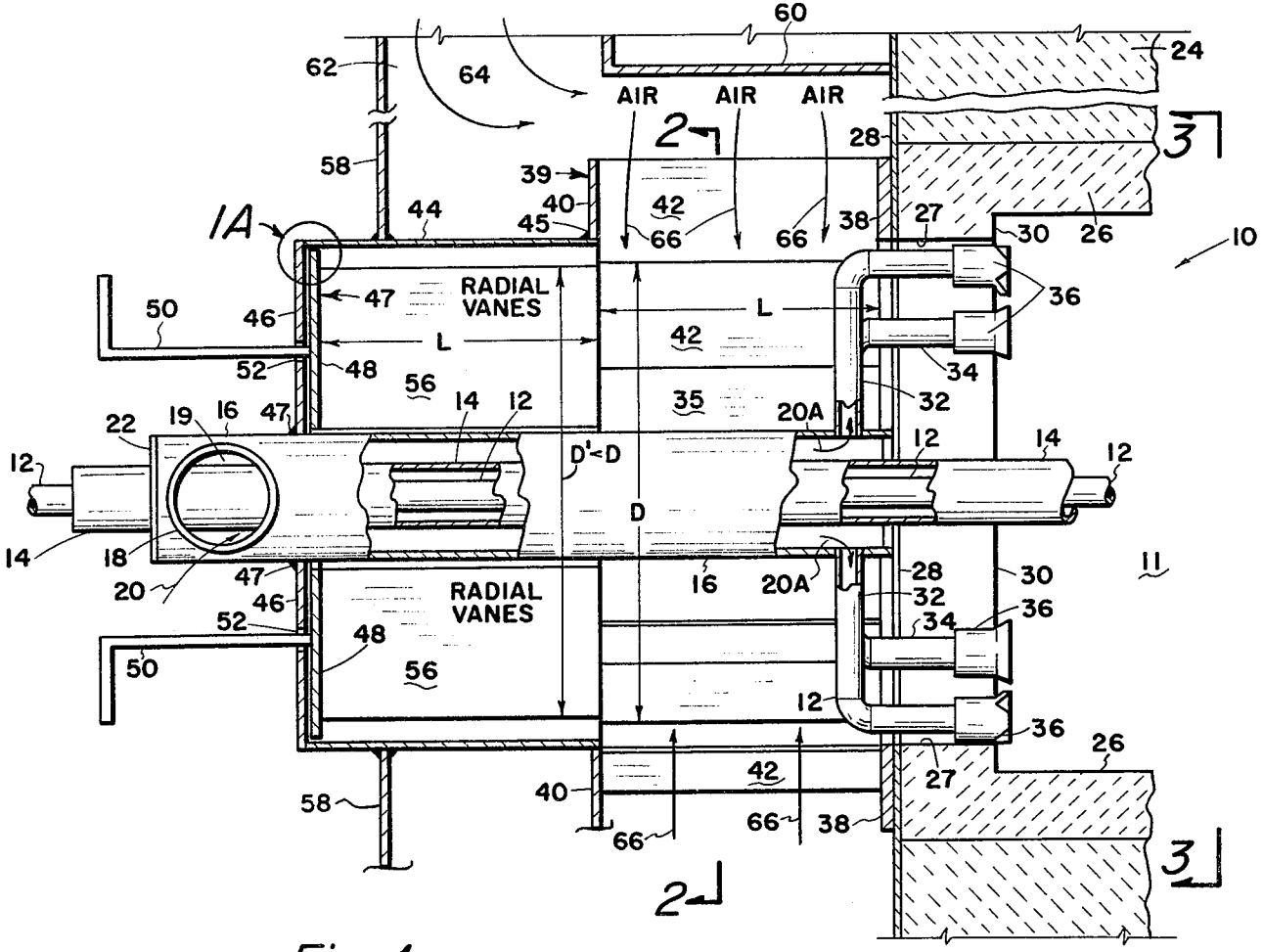
FIG. 1 represents one embodiment of the invention.

Referring now to the drawings and, in particular, to FIG. 1, there is shown one embodiment of the invention, which is shown by way of illustration and not by way of limitation.

The burner assembly is indicated generally by the numeral 10 and is attached to the outer wall 28 of a furnace. The furnace is indicated by a refractory wall 24 and a steel outer plate 28. The opening through the wall is provided by a circular tile 26 inserted into the wall of the furnace. The flame space is indicated by the numeral 11.

A burner tube 16 is shown in position along the axis of the central opening 27 in the tile 26. The burner tube comprises a liquid fuel supply tube 12, which is supported within a liquid fuel guide tube 14 of slightly larger diameter Surrounding the liquid fuel guide tube is an annular volume 19 within a burner tube 16. Gaseous fuel is flowed under pressure into this annular space 19, in accordance with arrow 20 through a pipe 18 which is welded into the burner tube 16.

The gaseous fuel flows through the pipe 18 into the annular space 19 and along the annular space and radially outwardly through a plurality of tubular arms 32, which are welded into a wall of a burner tube 16. The gas flowing into these arms is indicated by the arrows 20A. The tubular arms 32 are bent into an axial position indicated as 34, and are fitted with burner nozzles 36 of conventional form.

Immediately adjacent the outer surface 28 of the furnace wall is a first stationary annular vane assembly indicated generally by the numeral 39. This can be attached by conventional means to the metal covering 28 of the furnace wall. The inner diameter of the vanes 42, which are welded to annular plates 38 and 40, is of a diameter D, and surrounds an empty chamber volume 35. The positioning of the vanes 42 will be illustrated more completely with FIGS. 2 and 3. For the moment, it is sufficient to state that these vanes are positioned in a tangential direction, so that air flow between the vanes indicated by arrows 66, for example, will flow in a tangential manner into the space 35 of the chamber volume, and then in a helical manner, it will flow along the outside of the burner tube 16, past the burners 36, and into the flame volume 11.

Figure 1A:
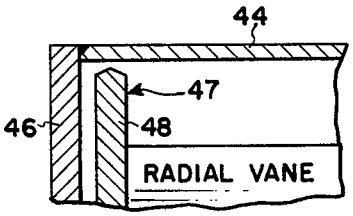

There is a cylindrical wall 44 attached to the plate 40 as by welds 45. This cylinder houses an annular volume outside of the burner tube 16, which is closed off by a wall 46 welded to the burner tube 16, as by welds 47 and to the cylindrical wall 44 as shown in FIG. 1A.

Outside of the cylindrical wall 44 there is a wind box enclosed by a cylindrical wall 60, which is attached to the furnace wall 28, and an end closure 58. An opening 62 in the cylindrical wall 60 provides the entrance for combustion air which may be driven by a blower, or by other conventional means, in accordance with arrows 64.

Inside of the annular space within the cylindrical wall 44 is a second vane assembly, indicated generally by the numeral 47, comprising a plurality of radial vanes 56 which are uniformly circumferentially spaced, and are welded to an annular plate 48 which is designed to slide freely around the outside of the burner tube 16, and within the cylindrical wall 44. A pair of rods 50 are provided, which pass through openings 52 in the wall 46 and are attached, as by welding, to the annular plate 48 so that by moving these rods 50 to the right, the assembly 47 of radial vanes, attached to the plate 48 can be moved correspondingly to the right, and into the volume 35 of the open chamber space.

The outer diameter of the movable vane assembly 47 is indicated as D′, which is slightly less than the inner diameter D of the first fixed vane system 39. Thus, by means of the handles 50, the second radial vane assembly 47 can be moved from a first position shown in FIG. 1, where it is completely outside of the chamber volume 35, to a second position, to the right, where the vanes 56 of length L are completely within the chamber volume 35 and completely inside of the circumferential vanes 42, which are, likewise, of an axial length L.

In FIGS. 1 and 1A it is shown that the movable wall 48 is slightly smaller in diameter than the wall 44 on the outside, and is slightly larger on its inner diameter, than the burner tube 16 so that it can be freely moved axially from the first to the second position. Also, it will be clear that, if it is positioned partly within and partly without the chamber space, there is no tendency by the air flow to move it inwardly or outwardly. Thus, an adjustment can be made by positioning the second vane assembly 48 so that part of the air flow through the vanes 42, indicated by numerals 66, will continue in a helical flow into a portion of the chamber space, and part of the air flow will flow into the radial vanes and, thus, will be prevented from flowing tangentially, and will flow, more or less, axially along the burner tube and past the burners into the flame zone 11.

Figure 2:
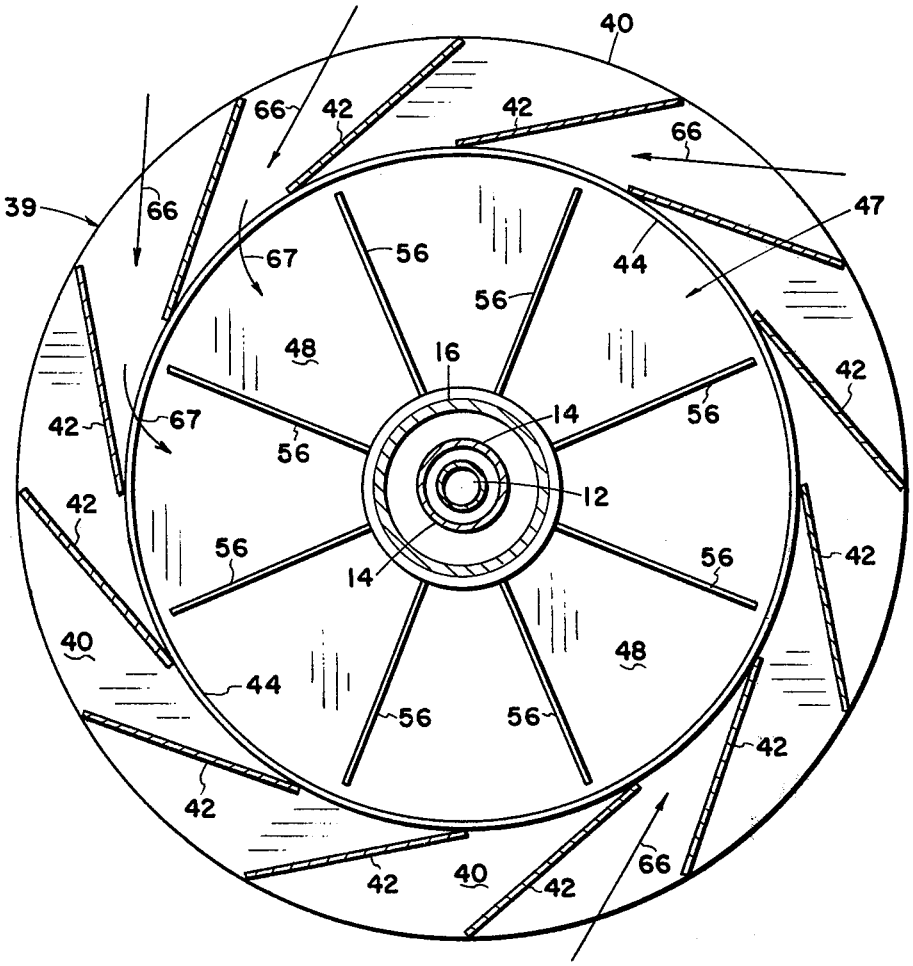
FIG. 2 illustrates a view taken along the plane of 2—2 of FIG. 1.

Referring now to FIG. 2, there is a cross-section taken across the plane 2—2 of FIG. 1. There are clearly shown a plurality of tangentially-directed vanes 42 which are part of the first vane assembly, indicated generally by the numeral 39. This is a fixed-vane assembly inside of the wind box.

Inside of the fixed annular tangential vane assembly 39 is shown the second movable vane assembly indicated generally by the numeral 47. It comprises the annular plate 48 with a plurality of circumferentially-spaced radial vanes 56, which are welded to the plate 48.

Air is provided from the wind box in accordance with arrows 66, which flow into the spaces between the tangential vanes 42 in accordance with arrows 66. If the second vane assembly 47 is withdrawn from the chamber space 35, then the tangentially-flowing air 66 continues in a helical manner to flow along the axis of the chamber space and into the space of the burners, and into the flame zone 11. However, if the second vane assembly 47 is in the chamber space 35, the arrows 66 will flow in accordance with arrows 67 into the space between the radial vanes 56, and will be forced to flow axially along the spaces between the vanes, and past the burners, and into the flame zone in a substantially axial manner.

One of the problems of the prior art has been that the control of tangential flow of air has been by means of movable tangential vanes, the angle of which were changed from radial to partially tangential position. It will be clear that, as the tangential position increases, the spaces between the vanes become narrower, and, therefore, there is a tendency to provide a greater pressure drop through the tangential vanes. Thus, the flow rate of air under constant pressure will be reduced in proportion to the square of the pressure drop.

In this invention the tangential vanes are fixed in direction so that there is no change in pressure drop through the tangential vanes so long as the input pressure of the combustion air is constant. Then the direction of the tangentially flowing air is changed, or is not changed, depending upon the position of the radial vane assembly 47. Consequently, the flow of combustion air is under constant input pressure, irrespective of the particular nature of the flow of the combustion air.

Figure 3:
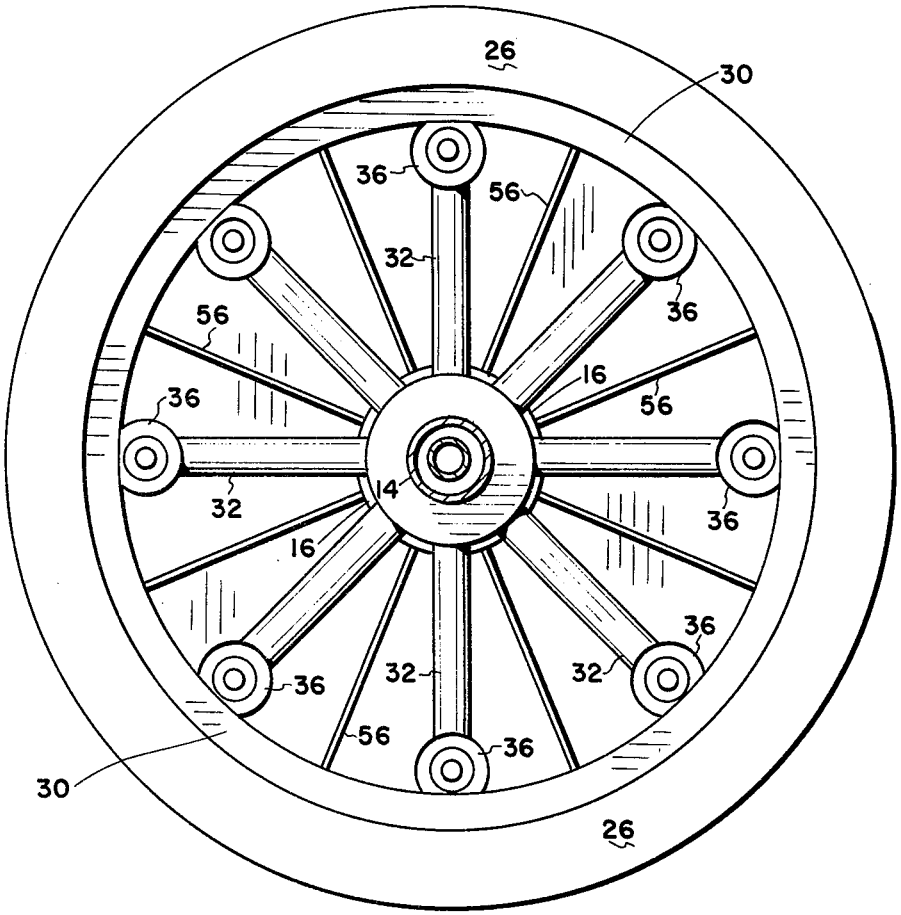
FIG. 3 illustrates a cross-section taken along the plane 3—3 of FIG. 1.

Referring now to FIG. 3, there is a view taken across the plane 3—3 of FIG. 1, which illustrates the construction of the gaseous burners 36, which are conventional in all respects. It is preferable, as is shown, that the number of radial vanes is equal to the number of gaseous burners for symmetrical purposes, even though the number of tangential vanes is, and can be, greater than the number of radial vanes. Substantially little detail is shown about the gaseous burners and none at all about the liquid burners since they are not part of the invention. The invention is primarily in the apparatus for control of the air flow direction.

While the invention has been described with a certain degree of particularly, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element or step thereof is entitled.

It is claimed:

1. A burner system for gaseous or liquid fuel, adapted for insertion through a circular tile opening in a furnace wall; comprising;

(a) a burner tube means to supply gaseous fuel to at least one gaseous fuel burner, and to supply liquid fuel to at least one liquid fuel burner; said burner tube means coaxial with, and inserted into said circular opening;

(b) a first annular vane assembly comprising a pair of spaced coaxial annular plates of substantially equal dimension, a plurality of tangentially-inclined vanes, equally angularly spaced, and rigidly attached in a fixed position to said annular plates at each end, the inner diameter of said tangentially-inclined vanes of selected value D;

(c) said first vane assembly mounted coaxial with said opening to the outer wall of said furnace;

(d) a circular cylindrical wall of selected axial length, and diameter attached to the outer one of said two annular plates; the annular space between said cylindrical wall and said burner tube closed off by a first annular wall;

(e) a second vane assembly comprising a second annular wall adapted to slide about said burner tube and inside said cylindrical wall, and a plurality of angularly and equally-spaced substantially planar radial vanes each located in a plane extending through the axis of the burner tube, rigidly attached in a fixed position at one end axially to said second annular wall, said assembly of diameter less than D;

(f) means to axially move said second vane assembly from and between a first position inside said cylindrical wall to a second position into the space inside said tangential vanes; and (g) means to force combustion air into the space between said tangential vanes;

whereby when said second vane assembly is in said first position, said combustion air will flow in a swirling helical flow downstream past said burners into said furnace; and when said second vane assembly is in its second position, said tangential flow of air set up by said tangential vanes will flow into said radial vanes, and will flow axially past said burners into said furnace.

2. The burner system as in claim 1 in which said liquid burner comprises a first axial liquid fuel tube leading to a liquid fuel nozzle, and supported in a liquid fuel guide tube.

3. The burner system as in claim 2 in which said gaseous fuel is supplied through the annular space between said liquid fuel guide tube and a coaxial gaseous fuel supply tube surrounding said liquid fuel guide tube.

4. The burner system as in claim 3 including a plurality of tangentially-spaced radial tubular arms inserted into the wall of said gaseous fuel supply tube, said radial tubular arms bent into axial positions and each terminated with a gaseous fuel nozzle.

5. A burner system for insertion through a circular tile opening in a furnace wall, comprising;

(a) a burner tube coaxial with said opening for supply of fuel to said burner;

(b) air register means including a first vane assembly having a plurality of tangentially-inclined circumferentially-spaced fixed vanes having an inner diameter D coaxial with said burner tube;

(c) a second vane assembly having a plurality of circumferentially-spaced fixed substantially planar radial vanes each located in a plane extending through the axis of the burner tube and of outer diameter less than D, and adapted to slide axially on said burner tube;

(d) means to move said second vane assembly axially from a first position outside of the space inside of said first vane assembly, to a second position inside of said first vane assembly; and (e) means to supply combustion air to said air register means;

whereby when said second vane assembly is in said first position, said combustion air will flow in a swirling helical flow downstream past said burners into said furnace; and when said second vane assembly is in said second position, said tangential flow of air will flow into said radial vanes, and will flow axially past said burners into said furnace.

* * * * *